US005219120A

United States Patent [19]

Ehrenberg et al.

[11] Patent Number: 5,219,120

[45] Date of Patent: Jun. 15, 1993

[54] APPARATUS AND METHOD FOR APPLYING A STREAM OF ATOMIZED FLUID

[75] Inventors: Scott G. Ehrenberg, Fishkill; Paul Alan; Elizabeth J. Wohlford, both of Kingston, all of N.Y.

[73] Assignee: Sono-Tek Corporation, Poughkeepsie, N.Y.

[21] Appl. No.: 735,071

[22] Filed: Jul. 24, 1991

[51] Int. Cl.[5] ..... B05B 17/06; B05B 13/00; B05B 15/04

[52] U.S. Cl. ..... 239/11; 239/296; 239/434; 118/300; 427/310; 427/600

[58] Field of Search ..... 239/102.1, 102.2, 290, 239/296, 295, 299, 434, 543, 8, 11; 118/300; 427/57, 310

[56] References Cited

U.S. PATENT DOCUMENTS

| | | | |
|---|---|---|---|
| 2,855,244 | 10/1958 | Camp | 299/1 |
| 3,145,931 | 8/1964 | Cleall | 239/102 |
| 3,294,058 | 12/1966 | Shriro | 118/11 |
| 3,400,892 | 9/1968 | Ensminger | 239/102 |
| 3,474,967 | 10/1969 | Bodine | 239/102 |
| 3,784,105 | 1/1974 | Goodinge et al. | 239/102 |
| 3,861,852 | 1/1975 | Berger | 431/1 |
| 3,970,249 | 7/1976 | Singer | 239/102.1 |
| 4,153,201 | 5/1979 | Berger et al. | 239/102 |
| 4,301,968 | 11/1981 | Berger et al. | 239/102 |
| 4,337,896 | 7/1982 | Berger et al. | 239/100 |
| 4,352,459 | 10/1982 | Berger et al. | 239/102 |
| 4,474,326 | 10/1984 | Takahashi | 239/102 |
| 4,527,507 | 7/1985 | Sawai et al. | 239/299 |
| 4,541,564 | 9/1985 | Berger et al. | 239/102 |
| 4,647,471 | 3/1987 | Jenkins | 118/300 |
| 4,655,393 | 4/1987 | Berger | 239/102.1 |
| 4,659,014 | 4/1987 | Soth et al. | 239/102.2 |
| 4,723,708 | 2/1988 | Berger et al. | 239/102.2 |
| 4,767,057 | 8/1988 | Degli et al. | 239/296 |
| 4,799,622 | 1/1989 | Ishikawa et al. | 239/102.2 |
| 4,821,948 | 4/1989 | Fisher et al. | 228/223 |
| 4,857,367 | 8/1989 | Thorn et al. | 239/295 |
| 4,978,067 | 12/1990 | Berger et al. | 239/102.2 |

FOREIGN PATENT DOCUMENTS

| | | | |
|---|---|---|---|
| 0214303 | 10/1984 | Fed. Rep. of Germany | 239/290 |
| 3523521 | 1/1986 | Fed. Rep. of Germany | 239/543 |
| 55-120472 | 9/1980 | Japan . | |
| 978934 | 3/1981 | U.S.S.R. . | |

OTHER PUBLICATIONS

Sono-Tek Corporation, Sales Literature, 1987.

Sono-Tek Corporation, Sales Literature, 1990.

Harvey L. Berger, *Anti-Stain Coating of Float Glass by Ultrasonics*, U.S. Glass, Metal & Glazing, May, 1991, pp. 36-39.

*Primary Examiner*—Andres Kashnikow
*Assistant Examiner*—Christopher G. Trainor
*Attorney, Agent, or Firm*—Kenyon & Kenyon

[57] ABSTRACT

An apparatus and method generates a stream of atomized fluid for applying a substantially uniform coating of atomized fluid to a surface, such as the application of a liquid flux coating to circuit boards. An ultrasonic atomizer discharges a conical spray pattern of atomized fluid, and an air horn discharges a stream of air intersecting the path of the atomized stream of fluid for entraining the atomized stream of fluid within the stream of air. Two air jets are located on either side of the ultrasonic atomizer relative to each other, and each discharges a low pressure jet of air in a direction substantially opposite to the direction of the other. Each jet of air in turn shears the conical spray pattern of atomized fluid into a respective plume of atomized fluid. The two plumes of atomized fluid are then entrained into the moving sheet of air discharged by the air horn, thus forming a substantially uniform linear dispersion of atomized fluid for coating a surface with the atomized fluid.

14 Claims, 2 Drawing Sheets

APPARATUS AND METHOD FOR APPLYING A STREAM OF ATOMIZED FLUID

FIELD OF THE INVENTION

The present invention relates to apparatus and methods for atomizing fluids and, more particularly, to apparatus and methods for applying a stream of atomized fluid to a surface.

BACKGROUND INFORMATION

Piezoelectric ultrasonic atomizers have been used in industrial applications to deliver a fine spray or mist for coating surfaces. One such atomizer is shown, for example, in U.S. Pat. No. 4,337,896 to Berger et al. Manufacturers often require such atomizers to be able to coat large surfaces at a time, and to coat the surfaces both completely and uniformly. One attempt to meet these requirements has been to increase the atomizing surface area of the atomizer. The geometric contour of the atomizing surface of an ultrasonic atomizer influences the spray pattern and density of the particles developed by atomization, and by increasing the atomizing surface area, the fluid flow rate can be increased. Thus, the atomizing surface area can be increased, for example, by providing a flanged tip, i.e. a tip of increased cross-sectional area, which includes the atomizing surface, and the spray pattern and density of the atomizer can be further affected by selecting the contour of the tip.

Known atomizers typically utilize a flanged tip which directs the fluid to the surface to be coated in a cylindrical or conical spray pattern. The cylindrical or conical spray patterns, however, invariably create nonuniform concentrations of the atomized fluid on the surface to be coated. Typically, higher concentrations of the atomized fluid are collected on the coated surface in the central area of the conical or cylindrical spray pattern in comparison to the outermost areas, thus forming a nonuniform coating on the surface. These atomizers also typically do not have the ability to apply a substantially uniform stream of atomized fluid to a surface at selected, variable widths.

SUMMARY OF THE INVENTION

The present invention is directed to an apparatus for generating a stream of atomized fluid. The apparatus comprises an atomizer for discharging an atomized stream of fluid, and an air unit for discharging a stream of air intersecting the path of the atomized stream of fluid for entraining the atomized stream of fluid within the stream of air. At least one air jet discharges a stream of air into the atomized stream of fluid for controlling the width of the atomized stream of fluid.

One apparatus of the present invention comprises a first air jet located on one side of the atomizer for discharging a first jet of air into the conical pattern of atomized fluid to form a first plume of atomized fluid. A second air jet is located on the other side of the atomizer relative to the first air jet for discharging a second jet of air into the conical pattern of atomized fluid in a direction substantially opposite the direction of the first air jet to form a second plume of atomized fluid. Preferably, the overall width of the first and second plumes of atomized fluid is selected by controlling the air pressure of the first and second air jets. In an apparatus of the present invention, the first and second air jets are each directed in a direction substantially perpendicular to the longitudinal axis of the atomizer for shearing the conical pattern to form the first and second plumes, respectively.

The present invention is also directed to a method for generating a stream of atomized fluid, comprising the following steps: discharging an atomized stream of fluid from an atomizer; directing at least one jet of air into the atomized stream of fluid to shear the atomized stream of fluid into at least one plume of atomized fluid; and directing a stream of air to intersect the at least one plume of atomized fluid to entrain the atomized fluid into the stream of air.

In one method of the present invention, two jets of air are directed into the atomized stream of fluid, and each jet is directed in a direction substantially opposite to the direction of the other to shear the atomized stream of fluid into at least two plumes of atomized fluid. The stream of air intersects both plumes of atomized fluid to entrain the plumes of atomized fluid into the stream of air. Preferably, the air pressure of the two jets is controlled to control the size of the plumes of atomized fluid.

One advantage of the apparatus and method of the present invention is that a substantially uniform dispersion of atomized fluid is generated, which can in turn be applied to uniformly coat a surface with the atomized fluid. Another advantage of the apparatus and method of the present invention is that by controlling the air pressure of the at least one jet of air, the width of the plumes and, thus, the width of the uniform dispersion of atomized fluid can be controlled. Accordingly, a substantially uniform dispersion of atomized fluid can be applied at selected widths, and can typically be applied uniformly at widths greater than prior methods and apparatus for applying atomized fluids to coat surfaces.

Other advantages of the apparatus and method of the present invention will become apparent in view of the following detailed description and drawings.

DETAILED DESCRIPTION

Figure 1:
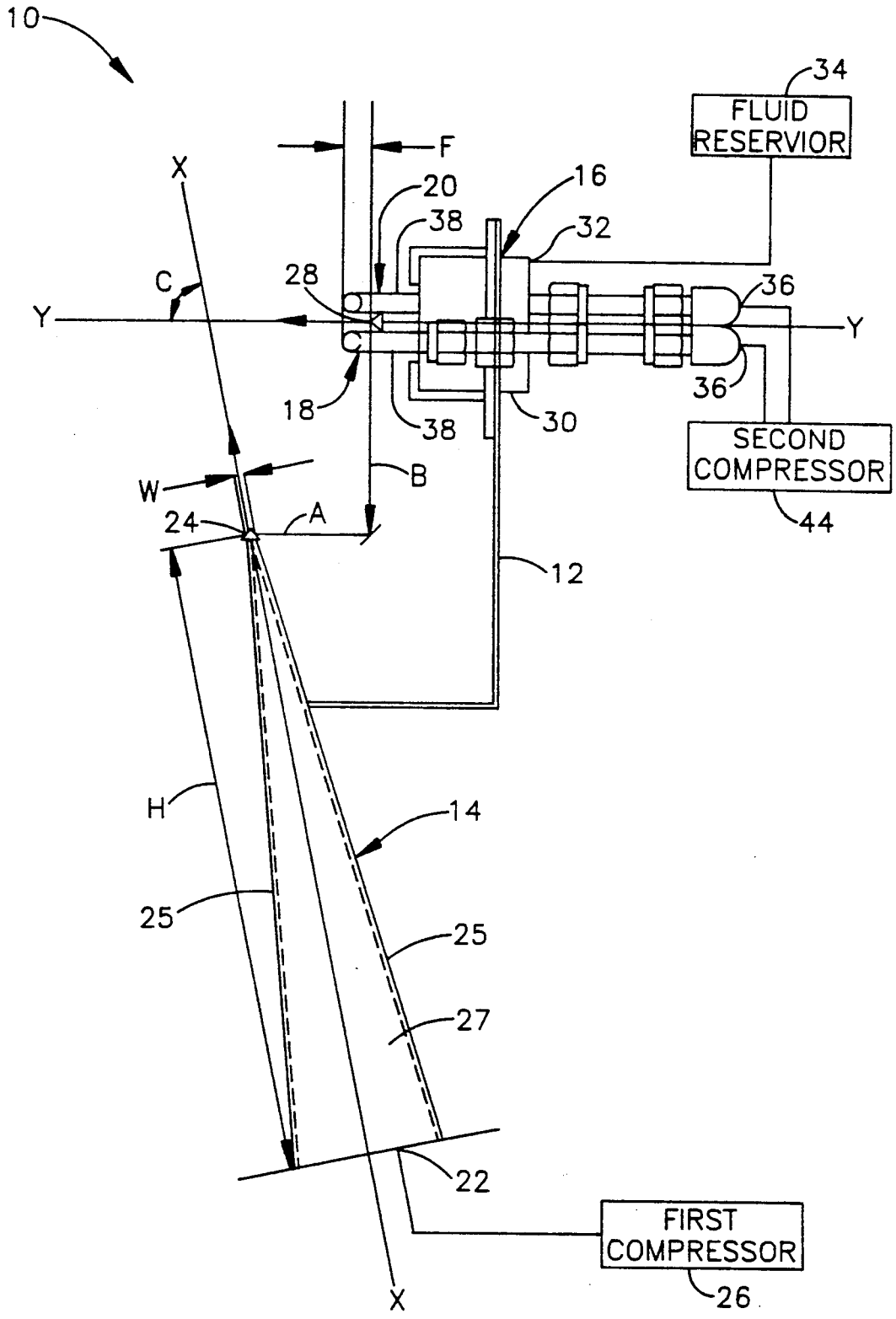
FIG. 1 is a side plan view of an apparatus for applying a stream of atomized fluid embodying the present invention.

In FIG. 1, an apparatus for applying a stream of atomized fluid to a surface for coating the surface is indicated generally by the reference numeral 10. In the embodiment of the present invention illustrated, the apparatus 10 is used to apply a uniform stream of atomized flux to circuit boards prior to soldering. As will be recognized by those skilled in the art, however, the apparatus and method of the present invention is not limited to this application but may equally be used to apply plastic, paint, fuel, or numerous other types of atomized fluids to surfaces.

Figure 2:
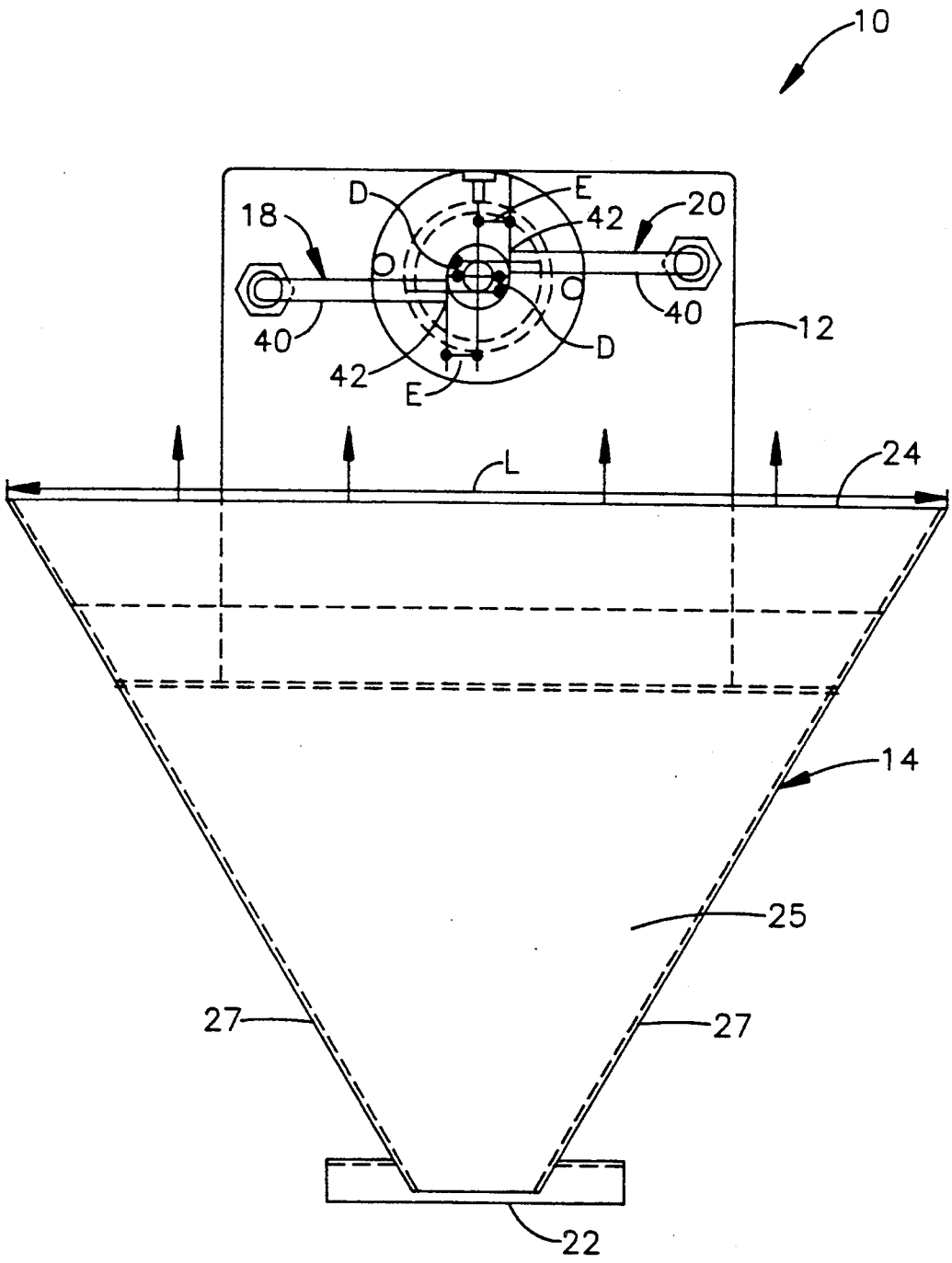
FIG. 2 is a front plan view of the apparatus shown in FIG. 1.

The apparatus 10 includes a frame 12, an air horn 14, an ultrasonic nozzle 16, and two opposing jets 18 and 20. As shown in FIG. 1, the frame 12 has a generally L-shaped configuration, and the air horn 14 is coupled to the base of the frame, and the ultrasonic nozzle 16 and two opposing jets 18 and 20 are coupled to the top portion of the frame. The air horn 14 defines an entrance opening 22 on one end for receiving a stream of air and an exit opening 24 on the other end for discharging the stream of air. The entrance opening 22 and the exit opening 24 each define a substantially rectangular cross section, the entrance opening being wider but not as long as the exit opening, as shown in FIGS. 1 and 2.

The air horn 14 includes four walls, each defining a substantially trapezoidal peripheral shape. The front and back walls 25 are mirror images of one another and are symmetrically oriented relative to each other on either side of the longitudinal axis X of the air horn. As shown in FIG. 1, the front and back walls 25 are each oriented at an acute angle relative to the longitudinal axis X. The two side walls 27 are also mirror images of one another and are oriented symmetrically relative to each other on either side of the longitudinal axis X. The side walls 27 are each also oriented at an acute angle relative to the axis X, and are each oriented in a plane substantially perpendicular to the planes of the front and back walls 25. Thus, as shown in FIGS. 1 and 2, the air horn 14 defines a substantially rectangular, yet varying cross-sectional area between the entrance opening 22 and exit opening 24 along the axis X. Preferably, the width W of the exit opening 24 (FIG. 1) is approximately 0.10 inches, the length L of the exit opening 24 (FIG. 2) is approximately 11.42 inches, and the height H of the air horn 14 is approximately 8.25 inches. As will be recognized by those skilled in the art, however, these dimensions are only exemplary, and can be changed as desired depending, for example, upon the application of the apparatus 10.

The entrance opening 22 is coupled to a first compressor 26 which supplies pressurized air to the air horn 14 which, in turn, discharges the air in a substantially uniform stream through the exit opening 24. In the embodiment of the present invention illustrated, the air pressure exiting the air horn 14 is preferably approximately 0.50 p.s.i. or less, and the flow rate is within the range of approximately 100 to 200 cfm. These pressures and flow rates are only exemplary, however, and may be changed as desired depending, for example, upon the use of the apparatus 10. The air horn 14 thus discharges a substantially uniform stream of air through the exit opening 24 which is directed substantially parallel to the longitudinal axis X and extends across the width of the exit opening 24, as indicated by the arrows in FIGS. 1 and 2. It should be pointed out that as will be recognized by those skilled in the art, numerous means other than the air horn 14 can be used to generate a substantially uniform moving stream of air in accordance with the present invention. The ultrasonic nozzle 16 simultaneously discharges an atomized stream of fluid substantially in the direction indicated by the arrow in FIG. 1, which is entrained by the moving stream of air, and thus forms a substantially uniform stream of atomized fluid for coating a surface, as is described further below.

The ultrasonic nozzle 16 includes a flanged atomizing tip 28, an ultrasonic electromechanical transducer 30, and an inlet passageway 32. The inlet passageway 32 is coupled to a fluid reservoir 34 for supplying fluid to the ultrasonic nozzle 16 which, in turn, atomizes and discharges the fluid in a substantially conical spray pattern through the flanged atomizing tip 28 in the direction indicated by the arrow in FIG. 1. The ultrasonic nozzle 16 is preferably a type known to those skilled in the art, such as the nozzle shown and described in U.S. Pat. No. 4,978,067, which is assigned to the same assignee as the present invention, and which is hereby expressly incorporated by reference as part of the present disclosure.

As shown in FIG. 1, the center of the exit opening 24 of the air horn 14 is spaced a distance A in front of the tip 28 of the ultrasonic nozzle 16, and a distance B below the longitudinal axis Y of the ultrasonic nozzle 16 (which extends through the centerline of the tip 28), as shown in FIG. 1. In the embodiment of the present invention illustrated, the distance A is approximately 1.52 inches and the distance B is approximately 2.78 inches. As also shown in FIG. 1, the air horn 14 is oriented relative to the ultrasonic nozzle 16 so that the longitudinal axis X of the air horn 14 intersects the longitudinal axis Y of the ultrasonic nozzle 16 at an acute angle C, which in the embodiment of the present invention illustrated is approximately 80°. These dimensions are only exemplary, however, and may be changed as desired or necessary depending, for example, upon the other dimensions or use of the apparatus 10.

The two jets 18 and 20 are each mounted to the frame 12 on an opposite side of the ultrasonic nozzle 16 relative to the other, as shown in FIG. 2. Each jet defines an entrance opening 36 in the free end of a first member 38, and an exit opening 42 in the free end of a second member 40, as shown in FIGS. 1 and 2. Each first member 38 is oriented substantially parallel to the longitudinal axis Y of the ultrasonic nozzle 16, whereas each second member 40 is oriented substantially perpendicular to the axis Y, thus forming a substantially L-shaped configuration. The entrance openings 36 are each coupled to a second compressor 44 for supplying compressed air to the jets 18 and 20 which each, in turn, discharges a jet of air in a direction substantially opposite to the direction of the other into the atomized, substantially conical stream of fluid discharged from the tip 28 of the nozzle 16, as indicated by the arrows in FIG. 2.

The jets 18 and 20 thus each discharge a low pressure jet of air in a direction opposite the other, and both substantially perpendicular to the axis Y of the nozzle 16. The two opposing jets of low pressure air shear the conical spray pattern exiting the nozzle 16 into left and right plumes (not shown), which are then entrained into the uniform stream of air discharged from the air horn 14, as is described further below. In the embodiment of the present invention illustrated, the air pressure exiting the jets 18 and 20 is preferably within the range of approximately 10 p.s.i. or less, and the flow rate of each jet is preferably within the range of approximately 500 cfm or less.

The centerline of the exit opening 42 of the jet 18 is located a distance D below the centerline of the tip 28 of the ultrasonic nozzle 16, and the centerline of the exit opening 42 of the jet 20 is located an equal distance D above the centerline of the tip 28, as shown in FIG. 2. The exit opening 42 of the jet 18 is also spaced a distance E to one side of the centerline of the tip 28, and the exit opening 42 of the jet 20 is spaced an equal distance E to the opposite side of the centerline of the tip 28, as shown in FIG. 2. The center of each exit opening 42 of the jets 18 and 20 is also spaced a distance F in front of the tip 28, along the longitudinal axis Y, as shown in FIG. 1. Preferably, the distance D is approximately 0.25 inches, the distance E is approximately 0.45 inches, and the distance F is approximately 0.25 inches. These dimensions, pressures, and flow rates are only exemplary, however, and may be changed as required depending, for example, upon the other dimensions or use of the apparatus 10.

In the operation of the apparatus 10 the flux (or other fluid to be sprayed) is pumped from the fluid reservoir 34 to the ultrasonic nozzle 16, which atomizes the flux in a substantially conical stream in the direction indicated by the arrow in FIG. 1. The two jets 18 and 20 then discharge the opposed low pressure jets of air in the directions indicated by the arrows in FIG. 2, which shear the conical spray pattern exiting the ultrasonic nozzle 16 into left and right plumes (not shown). The forward momentum of the atomized plumes carries the atomized fluid into the stream of air discharged by the air horn 14, which forms a sheet of air moving generally in the direction indicated by the arrows in FIGS. 1 and 2. When the left and right plumes encounter the sheet of air, the atomized fluid of the plumes is entrained into the moving sheet of air, creating a substantially uniform linear dispersion of atomized fluid moving above and extending substantially across the width of the air horn 14. The linear dispersion of atomized fluid is then directed onto the surface to be coated (not shown), which in the embodiment of the present invention illustrated would be a circuit board. Thus, because the dispersion of atomized fluid is substantially uniform, a substantially uniform coating of atomized fluid is formed when applied to the surface to be coated.

One advantage of the apparatus and method of the present invention, is that by selecting the air pressure of the opposed jets 18 and 20, the overall width of the plumes of atomized fluid can be adjusted and, consequently, the width of the linear dispersion of atomized fluid can be controlled. In the embodiment of the present invention illustrated, the width of the linear dispersion of atomized fluid can be as much as approximately 24 inches, but can be increased or decreased as desired by adjusting the air pressure of the opposed jets 18 and 20.

The present invention thus provides an apparatus and method for applying a stream of atomized fluid that is simple to manufacture, coats surfaces with an atomized fluid substantially uniformly, can be adjusted to coat surfaces with atomized fluids at varying widths, and can typically coat areas larger than conventional atomizers.

We claim:

1. An apparatus for generating a stream of atomized fluid comprising:

an atomizer for discharging an atomized stream of fluid;

an air unit for discharging a stream of air intersecting the path of the atomized stream of fluid for entraining the atomized stream of fluid within the stream of air; and at least one air jet for discharging a stream of air into the atomized stream of fluid to shear the atomized stream of fluid into at least one plume of atomized fluid.

2. An apparatus as defined in claim 1 comprising two air jets, each air jet being located on an opposite side of the atomizer relative to the other for discharging a jet of air in a substantially opposite direction relative to the other.

3. An apparatus as defined in claim 1, wherein the air unit discharges a substantially uniform stream of air which entrains the atomized stream of fluid to form a substantially uniform moving sheet of atomized fluid.

4. An apparatus as defined in claim 3, wherein the air unit defines a substantially rectangular discharge opening for discharging a substantially uniform moving stream of air.

5. An apparatus as defined in claim 1, wherein the atomizer is an ultrasonic atomizer for discharging a substantially conical pattern of atomized fluid.

6. An apparatus as defined in claim 1, wherein the atomized stream of fluid is flux for uniformly coating circuit boards.

7. A method for generating a stream of atomized fluid comprising the following steps:

discharging an atomized stream of fluid from an atomizer;

directing at least one jet of air into the atomized stream of fluid to shear the atomized stream of fluid into at least one plume of atomized fluid; and directing a stream of air to intersect the at least one plume of atomized fluid to entrain the atomized fluid into the stream of air.

8. A method as defined in claim 7, wherein two jets of air are directed into the atomized stream of fluid, each jet being directed in a direction substantially opposite to the direction of the other to shear the atomized stream of fluid into at least two plumes of atomized fluid, and the stream of air intersects both plumes of atomized fluid to entrain the plumes of atomized fluid into the stream of air.

9. A method as defined in claim 7, wherein the atomized stream of fluid is flux for coating printed circuit boards.

10. A method as defined in claim 7, wherein the stream of air defines a substantially uniform moving sheet of air which entrains the at least one plume of atomized fluid to form a substantially uniform dispersion of atomized fluid within the moving sheet of air.

11. A method as defined in claim 7, wherein the pressure of the at least one air jet is selected to control the size of the at least one plume of atomized fluid.

12. An apparatus for generating a stream of atomized fluid comprising:

an ultrasonic atomizer for discharging a substantially conical pattern of atomized fluid;

an air unit for discharging a stream of air intersecting the path of the atomized stream of fluid for entraining the atomized stream of fluid within the stream of air; and a first air jet located on one side of the atomizer for discharging a first jet of air into the conical pattern of atomized fluid to form a first plume of atomized fluid, and a second air jet located on the other side of the atomizer relative to the first air jet for discharging a second jet of air into the conical pattern of atomized fluid in a direction substantially opposite the direction of the first air jet to form a second plume of atomized fluid.

13. An apparatus as defined in claim 12, wherein the overall width of the first and second plumes of atomized fluid is selected by controlling the air pressure of the first and second air jets.

14. An apparatus as defined in claim 12, wherein the first and second air jets are each directed in a direction substantially perpendicular to the longitudinal axis of the atomizer for shearing the conical pattern to form the first and second plumes, respectively.

* * * * *